United States Patent [19]

Burger et al.

[11] 4,376,414

[45] Mar. 15, 1983

[54] PRINTING PLATE ATTACHMENT ARRANGEMENT

[75] Inventors: Rainer Burger, Augsburg; Werner Kleininger, Neusäss, both of Fed. Rep. of Germany

[73] Assignee: M.A.N.-Roland Druckmaschinen Aktiengesellschaft, Offenbach am Main, Fed. Rep. of Germany

[21] Appl. No.: 260,686

[22] Filed: May 5, 1981

[30] Foreign Application Priority Data

May 13, 1980 [DE] Fed. Rep. of Germany ..... 3018249

[51] Int. Cl.[3] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 2,229,059 | 1/1941 | Ditty et al. | 101/415.1 |
| 3,408,933 | 11/1968 | Hermach et al. | 101/415.1 |
| 3,425,348 | 2/1969 | Hermach et al. | 101/415.1 |
| 3,608,487 | 9/1971 | Luehrs | 101/415.1 |
| 4,061,087 | 12/1977 | Hill | 101/415.1 |
| 4,277,164 | 7/1981 | Fortmann | 101/415.1 X |

FOREIGN PATENT DOCUMENTS

| | | | |
|---|---|---|---|
| 2334127 | 1/1975 | Fed. Rep. of Germany . | |
| 2620427 | 6/1978 | Fed. Rep. of Germany . | |
| 7825185 | 12/1978 | Fed. Rep. of Germany . | |
| 2744371 | 4/1979 | Fed. Rep. of Germany | 101/415.1 |
| 269525 | 7/1950 | Switzerland | 101/415.1 |
| 609277 | 2/1979 | Switzerland | 101/415.1 |
| 1556389 | 11/1979 | United Kingdom | 101/415.1 |

*Primary Examiner*—Clifford D. Crowder

*Attorney, Agent, or Firm*—Frishauf, Holtz, Goodman & Woodward

[57] ABSTRACT

To permit clamping of a flexible printing plate (2) around a circumference of a printing cylinder (1) in either direction, a clamping groove (3) is formed with two inclined side walls (4, 5) which converge towards the open side of the groove, and are positioned in mirror-image relation with respect to a central plane (10) passing through the midpoint of the groove. A leaf spring element (11, 12; 11', 11"; 12') having two clamping portions (13, 14), shaped and positioned to fit against opposite walls (4, 5) of the groove, clamps the end portions (8, 9) of the plate against one of the side walls, the clamping portions being pressed into position by a clamping wedge body (16) having matching outwardly shaped surfaces and fitting against the clamping portions of the spring, the clamping wedge body being pressed outwardly to wedge the clamping wedge body (16) by a compression spring (15) bearing against the bottom (6) of the groove.

11 Claims, 4 Drawing Figures

PRINTING PLATE ATTACHMENT ARRANGEMENT

The present invention relates to printing machinery, and more particularly to the attachment arrangement to attach a flexible or bendable printing plate on the plate cylinder of a rotary printing machine.

BACKGROUND

Many rotary printing machines which accept printing plates of the bendable or flexible type are formed with grooves extending parallel to the axis of rotation of the plate cylinder in which the grooves include clamping or other attachment arrangements to attach the printing plates thereinto and retain them in position around the circumference of the cylinder.

Various attachment arrangements are described in the literature, for example German Patent Disclosure Document DE-OS No. 23 34 127; Published Patent Application DE-AS No. 26 20 427; Utility Model DE-GM No. 78 25 185. The attachment described in any one of the aforementioned publications includes a clamping device with a clamping spring and a clamping body and an additional separate tensioning element. The use of a separate tensioning element requires formation of the groove into which the plate is placed of sufficient size to accept the tensioning element, so that the overall groove will be relatively large. Additionally, the groove must be shaped precisely as required. Apparatus is needed to twist, turn, or clamp the tensioning element. Consequently, manufacture of such an attachment arrangement is comparatively expensive and requires substantial steps in machining and metal working. The solutions described in the publications DE-OS No. 23 34 127 and DE-GM No. 78 25 185 only permit placement of a printing plate in a single predetermined position on the plate cylinder due to the specific way the groove is constructed. Consequently, reversal of the printing plate and positioning of the plate in reverse direction on the printing cylinder is not possible with those arrangements.

THE INVENTION

It is an object to provide a simple clamping or attachment arrangement for printing plates to secure the plates on printing cylinders, which permits ready and easy attachment of the plate without special handling and without requiring any special tools, and in which the printing plate can be mounted in any desired direction.

Briefly, the groove of the printing cylinder is defined by two inclined walls which converge towards the open side of the groove and which are positioned in mirror-image relationship with respect to a central plane passing through the midpoint of the groove. The angles of inclination form an acute angle with respect to a tangent of the printing cylinder at the junction of the groove and the outer surface of the cylinder. Resilient leaf spring elements are retained within the groove, the leaf spring elements having clamping portions shaped and positioned to fit against opposite walls of the grooves. A clamping wedge body is provided having outwardly shaped surfaces fitting against the inner sides of the clamping portions of the leaf spring. The clamping wedge body is pressed against the leaf springs to clamp them firmly against the side walls by a spring tending to push the clamping wedge body in wedging direction towards the outer portions of the groove with the converging walls. The clamping portions of the leaf spring thus will be outwardly deflected and can press against fitting converging side walls of the groove, the end portions of the printing plate being clamped between one of the leaf spring elements and the adjacent wall, the other side of the clamping wedge body bearing against the leaf spring element which is supported by engagement with the other adjacent wall of the groove.

DRAWINGS

The same reference numerals have been used for similar parts throughout the description and these elements will be described only once.

Figure 1:
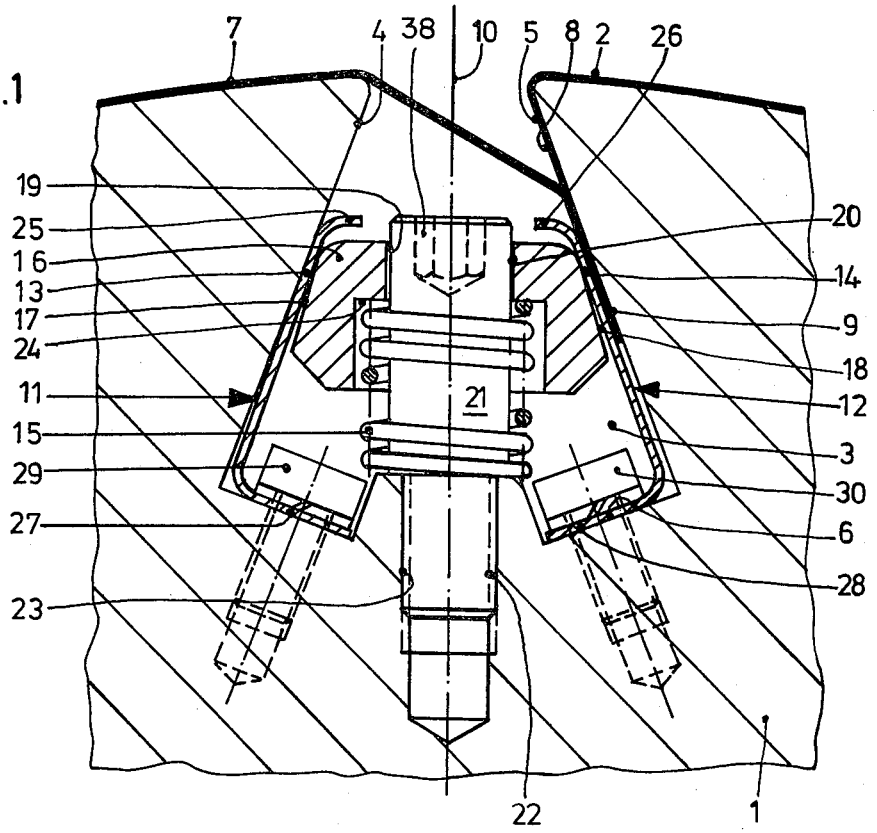
FIG. 1 is a highly schematic cross-sectional view through a portion of the plate cylinder of a rotary printing machine and illustrating the cross-sectional shape of the groove and a first embodiment of a clamping arrangement.

A plate cylinder 1, forming part of a rotary printing machine not further shown, has a flexible printing plate 2 applied to the circumference thereof. The plate cylinder has a groove 3 formed therein, extending parallel to the axis of rotation of the cylinder. The groove is defined by two side walls 4 and 5 at the left and right side—with reference to the drawings—respectively. The bottom of the groove 6 can be shaped in various ways, as will appear. The groove 3 receives the various elements and parts of the arrangement to attach the flexible printing plate 2 to the printing cylinder 1.

In accordance with a feature of the present invention, the walls 4, 5 of the groove converge, that is, they extend from a wider bottom 6 towards each other to form an acute angle with a tangent of the surface 7 of the plate cylinder 1. The printing plate 2 has a beginning or start portion 8 which is angled, and an end portion 9, likewise angled off the curvature of the circumference of surface 7 of the plate cylinder. The clamping arrangement is symmetrical with respect to a central plane, shown in the drawings as center line 10, and extending radially from the center of rotation of the printing cylinder 1. The two side walls 4, 5, in accordance with a feature of the invention, are mirror images, or mirror-symmetrical with respect to the central plane 10 of the groove 3, and form the same acute with respect to the surface 7 of the plate cylinder. This arrangement permits placement of the flexible printing plate 2 in either direction of clamping, in which the starting portion 8 of the printing plate 2 is engaged at the right side wall 5 of the groove 3, as well as in the reverse direction in which the starting or beginning portion 8 of the printing plate 2 is placed against the left side wall 4 of the groove 3. The printing plate, thus, can be accurately secured in either direction of placement on the printing cylinder 1, with exactly defined position thereon. Special arrangements and alignment requirements with respect to the printing plate as such thus can be omitted since the printing plate can be aligned in either direction of orientation.

In accordance with a feature of the invention, the printing plate 2 is clamped against the cylinder 1 by a spring clamping arrangement which, in operation, is further assisted by centrifugal force. Two leaf springs 11, 12, each having a clamping portion 13, 14, are placed to fit essentially against preferably at least a major portion of the walls 4, 5 of the groove 3. A clamping wedge body 16 having outer wedge surfaces 17 and 18 is placed between the springs 11, 12, to press the clamping portions 13, 14 of the leaf springs 11 and 12 in the direction of the next adjacent side wall 4, 5, respectively, of the groove 3. The clamping wedge body 16 is loaded by a compression spring 15 which tends to press the clamping wedge body outwardly—with respect to the depth of the groove—and thus wedge the outer surfaces 17, 18 against the clamping portions 13, 14 of the two leaf springs 11, 12. The arrangements permit clamping both the sharply angled starting end 8 of the printing plate 2, as well as the obtusely angled trailing end 9 of the printing plate between the wall 5 of the groove and the clamping portion 14 of spring 12, the adjacent surface 18 of the clamping wedge portion securely holding the ends 8, 9 of the printing plate in position. The other, opposite surface 17 of the clamping wedge 15 is securely supported by engagement with the adjacent clamping portion 13 of spring 11 which bears against the side wall 4 of the groove. Of course, the arrangement can be reversed since the respective surfaces and springs are mirror images.

In accordance with a feature of the invention, the spring force exerted by spring 15 is assisted in operation by centrifugal force acting on the clamping wedge body 16. The faster the printing cylinder rotates, and the more clamping force there is required, the greater the clamping force will be due to centrifugal force acting on the body 16. The spring 15 is of sufficient strength to effect initial secure clamping of the printing plate 2 in position.

The clamping wedge body 16 is guided by a cylindrical guiding bolt or shaft 20 which fits into a through bore 19 of the body 16. The guiding element or shaft 20 is formed as a surface of a guide bolt 21 which is secured in a tapped bore 23 of the plate cylinder 1. The bolt 21 is secured against loosening by suitable elements 22, for example a tapped counter nut or the like, a central spreading bolt, or other suitable arrangement. The guide shaft 20 on the bolt 21 not only guides sliding movement of the wedge body 16, but also provides for centering of spring 15 which, on the one hand, engages an interior surface 24 formed in the wedge clamping body 16 and, on the other, on the bottom 6 of the groove 3.

The foregoing basic construction utilizes, in the embodiment of FIG. 1, two separate leaf springs 11, 12. The leaf springs are individual single-piece elements which can be identical. Each one of the leaf springs 11, 12 is formed with an initial inwardly bent portion 25, 26, angled over towards the central plane 10 of the groove 3 at the end adjacent the surface 7 of the plate cylinder 1 in order to facilitate introduction of the end portions 8, 9 of the printing plate 2 between the respective spring and the respective side wall 4, 5 of the groove 3. The inner end portions of the leaf springs 11, 12 are bent inwardly as seen at 27, 28, and engage against the bottom 6 of the groove 3, where they are retained in position by a suitable bolt or screw 29, 30. Other attachment arrangements may be used.

Figure 2:
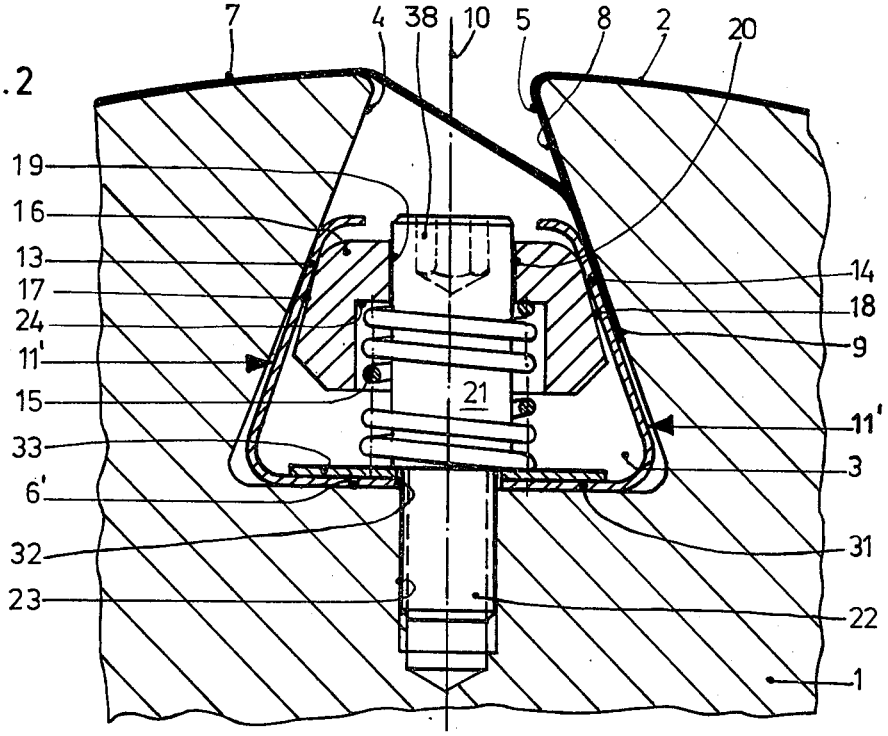
FIG. 2 is a view similar to FIG. 1, illustrating another clamping arrangement.

Embodiment of FIG. 2: Basically, the construction is the same, except that the bottom 6' of the groove 3 is flat. The leaf springs are combined to form a single spring element 11' which is formed with a central through-hole 32 to pass the threaded portion 22 of the bolt 21 therethrough. A washer 33 is positioned between the bolt 21 and the connecting strip 31, and the bolt 21 as such serves to secure the spring 11' in position. The washer 33 essentially entirely covers the connecting strip 31 so that change in shape thereof, or rising of the bottom portion off the bottom 6' of the groove is effectively prevented.

Figure 3:
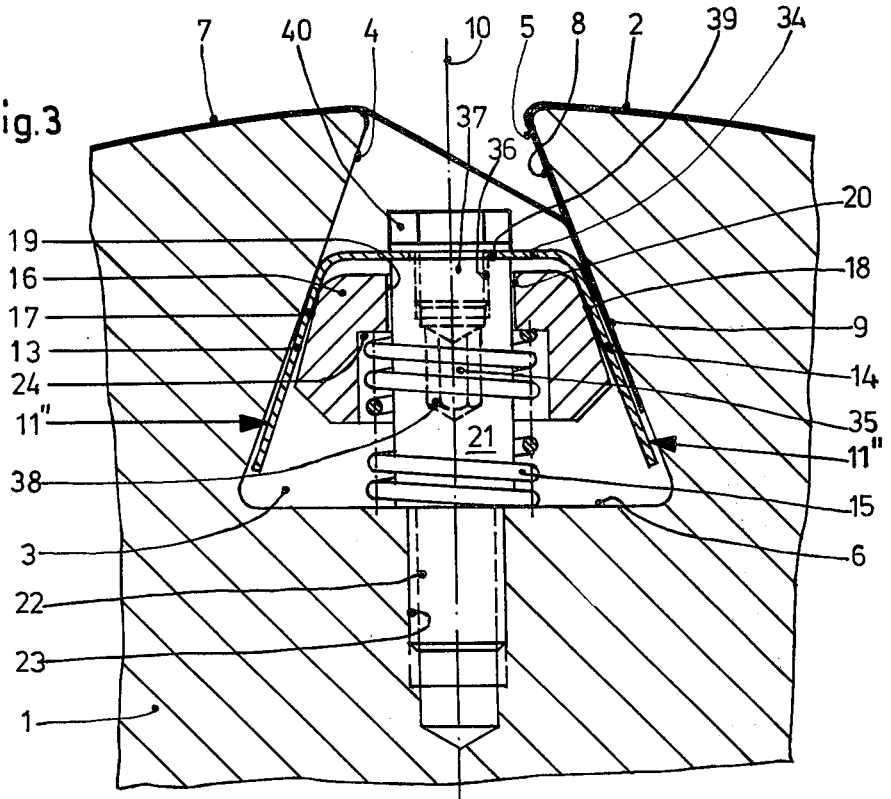
FIG. 3 is a view similar to FIG. 1, illustrating yet another clamping arrangement.

Embodiment of FIG. 3: The spring 11" again is a unitary element, as in the embodiment of FIG. 2, but has a connecting strip which is placed at the upper side of the wedge clamping body 16. A bent connecting strip 34 connects the clamping portions 13, 14 of the leaf spring 11", the strips 34 being secured at the outer end to the guide bolt 21. The guide bolt 21 is formed with a blind bore 35 which, at its outer portion, has a thread 36 to receive a screw 37. The inner portion of the blind bore 35 is formed in hexagonal shape, as seen at 38, to receive a suitable wrench, for example an Allen wrench, to screw the bolt 21 into the matching tapped hole in the plate cylinder 1. The cross strip or bridge 34 is formed with a hole 39 to permit passage of the screw 37 therethrough. The head 40 of the screw 37 retains the strip or bridge 34 of the spring 11" against the bolt 21.

Figure 4:
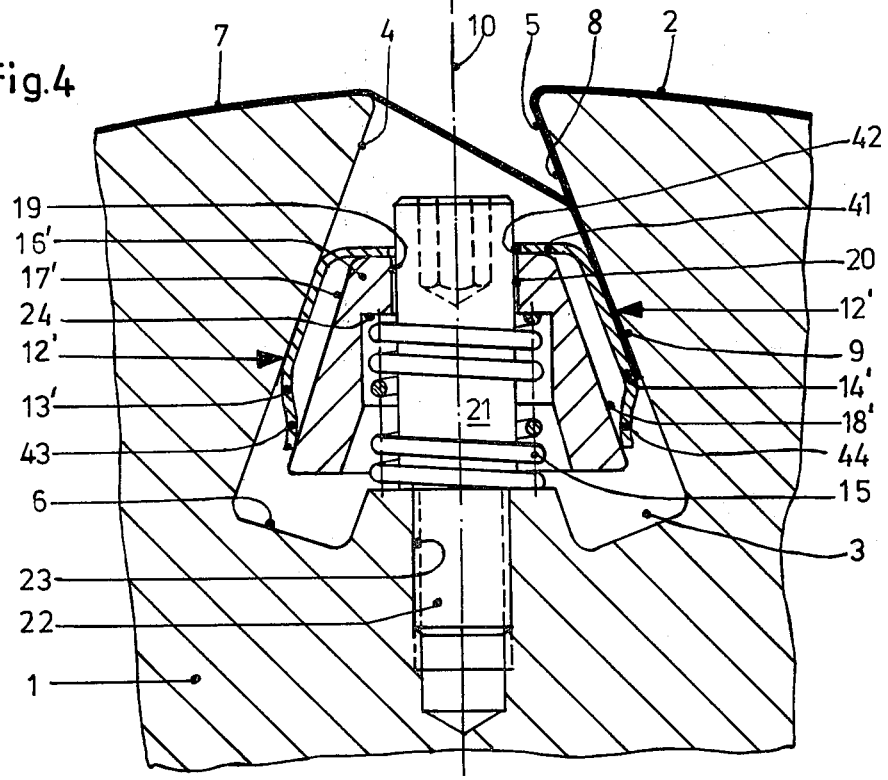
FIG. 4 is a view similar to FIG. 1, illustrating still another clamping arrangement.

Embodiment of FIG. 4: A unitary spring element 12' is provided which, similar to FIG. 3, is secured at the upper end portion of the wedge body 16, as in FIG. 3. The two clamping portions 13, 14 of the spring element 12' are connected by a bridge or strip 41. The single unitary spring element 12' is formed with a hole 42 in the center of the bridge or strip 41, the hole 42 having a diameter equal to or just slightly larger than the diameter of the guide bore 19 in the wedge body 16. The spring element 12' is connected to the upper surface of the wedge body 16 by suitable means, for example by spot welding. The wedge-shaped clamping surfaces 17', 18' on the wedge clamping body 16' are spaced from the inner surfaces of the clamping portions 13', 14' of the spring 12' to provide clearance for compression of the clamping portions 13', 14' of the spring 12'. The clamping portions 13', 14' are formed with engagement or abutment or support arm portions 43, 44 at the ends facing the bottom 6 of the groove, so that the spring ends engage the respective surfaces 17', 18' of the wedge clamping body 6' in a region of the lower third thereof.

The arrangement requires only few components, all of which are easy to manufacture and to assemble in the groove 3. The groove 3 is open at one axial end, so that the wedge body 16 as well as the spring elements can be slide axially into the groove. The arrangement permits extremely simple mounting of a flexible printing plate 2 on the plate cylinder 1, requiring only little manipulation and no special tools.

Assembly of printing plate, and operation: A printing plate 2 is positioned, in accordance with a selected direction of clamping, so that the start portion 8 matches against one of the two side walls 4, 5 of the groove. It is pushed into the groove until the start portion of the printing plate is gripped by the respective clamping portions 13, 14, respectively, of the clamping spring, and then continued to be pushed into the groove until it has reached its end position. The plate 2 is then bent and pulled over the plate cylinder 1; the trailing end 9 of the printing plate is then pushed into the groove 3 along the initial portion 8 of the printing plate, and pushed further in the direction of the bottom of the groove 3 until it has reached its final, stretched and clamped position. The spring 15 presses the wedge clamping body in the direction of the outer circumference or surface 7 of the plate cylinder 1. The respective clamping spring portions 13, 14 will then engage and clamp the next adjacent portion of the end 9 of the printing plate which, in turn, presses against the starting portion 8 thereof which, again, is engaged and gripped by the wall 4, or 5, respectively, of the groove. The oppositely positioned clamping portion will engage against the respective opposite wall of the groove.

After assembly, and while the plate cylinder is stationary, the clamping wedge body will receive a final position which is determined by the geometry of the springs 11, 11', 11'', 12, 12' of the force of the spring 15, and the surface characteristics of the adjacent surfaces which engage against each other. The force of the spring 15 is so dimensioned that, upon quiescent plate cylinder, the clamping wedge body 16 will press with sufficiently high force against the clamped end 9 of the printing plate 2.

In operation, and when the printing cylinder rotates, the spring-loaded clamping wedge 16 is pressed with still additional force against the end portion 9 of the printing plate. The spring bias clamping force will be subjected to centrifugal force so that, upon rotation of the plate cylinder, and depending on speed, the initial spring-loaded clamping force is increased.

The unilateral clamping of the starting end 8 of the printing plate as well as of the trailing end 9 provides for covering of a major portion of the space within the groove 3; the clamping elements or clamping components—the springs, the clamping wedge, and holding components, are covered by the span of the end 9 of the printing plate, and thus are protected against contamination by dirt, printing ink, and the like, so that trouble-free operation is insured.

Various changes and modifications may be made, and features described in connection with any one of the embodiments may be used with any of the others, within the scope of the inventive concept.

If springs 15 of high force are used, it is possible to compress the springs manually and thus facilitate insertion of at least one end portion of the printing plate, for example by forming a washer or projecting flange on the bolt 21 which can press against the spring 15 independently of its engagement with the clamping wedge body 16. By engaging the bolt, for example with a ratchet socket wrench or the like, the spring 15 can then be compressed, thus permitting free sliding movement of the wedge body 16 and loosening of the spring portions 12, 13 with respect to the matching side walls. A flange or a releasable holding connection, such as a snap-in C-ring, fitting into a suitable groove, can be used. Such a snap-in ring can be removed if it is desired to withdraw the bolt 21.

We claim:

1. Printing plate attachment arrangement to secure a flexible printing plate (2) to the surface of a printing cylinder (1) of a rotary printing machine, said printing cylinder (1) being formed with a groove (3) extending parallel to the axis of rotation of the cylinder and having resilient means (11, 12) to press end portions (8, 9) of the printing plate (2) against the walls of the groove, wherein the groove (3) is defined by two inclined walls (4, 5) which converge towards the open side of the groove and which are positioned in mirror-image relation with respect to a radially extending center plane (10) passing through a median point of the groove, said inclined walls defining angles of inclination with respect to a tangent of the cylinder of the junction of the groove and the outer surface (7) of the cylinder, said angles being acute angles;

the resilient means comprises leaf spring means (11, 12; 11', 11'', 12') having two clamping portions (13, 14) shaped and positioned to fit against opposite walls (4, 5) of the groove;

a clamping wedge body (16) is provided having outwardly shaped surfaces (17, 18) fitting against said clamping portions (13, 14) of the leaf spring means;

means (21) are provided for guiding said clamping wedge body (16) for radial movement in said center plane (10) within the groove;

and spring means (15) are positioned to engage said clamping wedge body and biasing said clamping wedge body (16) in radially outward direction, whereby the clamping portions of the leaf spring means will be outwardly deflected and pressed against the converging side walls of the groove.

and wherein the end portions (8, 9) of the printing plate cylinder are wedged between one leaf spring clamping portion (14) and the adjacent wall (5) of the groove by clamping engagement of the leaf spring portion with the adjacent wedge surface (18) of the clamping wedge body (16), the other side (17) of the clamping wedge body bearing against the other leaf spring clamping portion (11) and being supported by engagement of said clamping portion against the adjacent wall (4) of the groove (3).

2. Arrangement according to claim 1, wherein said clamping wedge body (16) is formed with a central through-bore (19);

said guide means (21) comprises a bolt (21) secured in the plate cylinder (1) in the bottom (6) of the groove, said bolt sliding within said center through-bore to thereby guide said clamping wedge body;

and wherein said spring means (15) comprises a compression spring bearing against the bottom (6) of the groove, surrounding said bolt (21) and further bearing against said clamping wedge body (16) to press said body (16) outwardly with respect to said groove and thereby effect clamping action with respect to the converging walls (4, 5) of the groove.

3. Arrangement according to claim 1, wherein (FIG. 1) said leaf spring means comprises two identical leaf spring elements (11, 12) located on either side of the clamping wedge body (16), each element engaging one of the walls (4, 5) of the groove (3).

4. Arrangement according to claim 3, wherein said leaf spring elements each are formed with inwardly bent portions (25, 26, 27, 28) adjacent the ends thereof, the inwardly bent portions (25, 26) adjacent the ends facing the outer, open end of the groove projecting inwardly to facilitate insertion of the end portions (8, 9) of the plate cylinder, and the inwardly bent portions (27, 28) adjacent the inner end of the groove forming seating surfaces fitting against the bottom (6) of the groove.

5. Arrangement according to claim 4, further comprising holding elements (29, 30) clamping the inwardly bent portions (27, 28) of the leaf spring element (11, 12) adjacent the inner end of the groove against the bottom (6) of the groove.

6. Arrangement according to claim 1, wherein (FIGS. 2, 3, 4) the leaf spring means comprises a single spring element (11', 11'; 12') having said clamping portions (13, 14) formed at the outer end portions thereof, said outer end portions being connected by a connecting bridge or strip (31, 34, 41), said leaf spring means being engaged in the region of said strip or bridge to retain said leaf springs in the groove.

7. Arrangement according to claim 6, wherein (FIG. 2) said leaf spring means is formed with a central bore (32) receiving said guide means for said clamping wedge body;

and compression means (33) engaged by said guide means and securing said leaf spring means in the region of said bridge against the bottom (6') of the groove.

8. Arrangement according to claim 6, wherein (FIGS. 3, 4) said clamping wedge body is formed with an outer engagement face;

and said bridge or strip (34, 41) is secured in said groove in a position in which the bridge or strip is adjacent the outer face of the clamping wedge body.

9. Arrangement according to claim 8, further including (FIG. 3) an attachment screw (37, 40) passing through an opening (39) in the bridge or connecting strip of said leaf spring means and into the guide means (21) for said wedge shaped body.

10. Arrangement according to claim 8, wherein (FIG. 4) said bridge or strip (41) is in engagement with the end face surface of the clamping wedge body (16) and secured thereto.

11. Arrangement according to claims 1 or 10, wherein the outer surfaces (17', 18') of the wedge clamping body (16) are spaced from the inner surfaces of the clamping portions (13', 14') of the leaf spring means, and said clamping portions have free end portions bent inwardly and in engagement with the outer surfaces (17', 18')of the clamping wedge body (16') to insure resilient force transfer between the clamping wedge body, the adjacent clamping portions of the spring means, and the adjacent walls (4, 5) of the groove.

* * * * *